US005391449A

United States Patent [19]

Maruyama et al.

[11] Patent Number: 5,391,449

[45] Date of Patent: Feb. 21, 1995

[54] ELECTROPHOTOGRAPHIC PHOTOSENSITIVE MEMBER

[75] Inventors: Akio Maruyama; Shin Nagahara, both of Tokyo; Noriko Ohtani, Yokohama; Shinya Mayama, Yamato, all of Japan

[73] Assignee: Canon Kabushiki Kaisha, Tokyo, Japan

[21] Appl. No.: 31,023

[22] Filed: Mar. 11, 1993

Related U.S. Application Data

[63] Continuation of Ser. No. 709,822, Jun. 4, 1991, abandoned.

[30] Foreign Application Priority Data

Jun. 4, 1990 [JP] Japan ..... 2-146431

[51] Int. Cl.[6] ..... G03G 5/14

[52] U.S. Cl. ..... 430/66; 355/271

[58] Field of Search ..... 430/66

[56] References Cited

U.S. PATENT DOCUMENTS

| | | | |
|---|---|---|---|
| 4,047,963 | 9/1977 | Simpson | 96/115 R |
| 4,062,681 | 12/1977 | Lewis et al. | 96/1.5 N |
| 4,092,173 | 5/1978 | Novak et al. | 96/119 R |
| 4,181,526 | 1/1980 | Blakey et al. | 430/67 |
| 4,362,799 | 12/1982 | Kondo et al. | 430/67 |
| 4,426,435 | 1/1984 | Oka | 430/132 |
| 4,657,835 | 4/1987 | Yashiki | 430/60 |
| 4,758,492 | 8/1988 | Nair | 430/114 |
| 4,920,037 | 4/1990 | Takahashi et al. | 430/287 |

FOREIGN PATENT DOCUMENTS

| | | | |
|---|---|---|---|
| 0277039 | 8/1988 | European Pat. Off. | G03G 5/06 |
| 0308185 | 3/1989 | European Pat. Off. | G03G 15/02 |
| 425224 | 5/1991 | European Pat. Off. . | |
| 57-30843 | 2/1982 | Japan . | |

OTHER PUBLICATIONS

Patent Abstracts of Japan, vol. 13, No. 82 [P-833] [3430] JPA 63-264767 Feb. 23, 1989.

*Primary Examiner*—John Goodrow

*Attorney, Agent, or Firm*—Fitzpatrick, Cella, Harper & Scinto

[57] ABSTRACT

An electrophotographic photosensitive member is formed by disposing a photosensitive layer and a protective layer in this order on an electroconductive support. The protective layer is formed from a resin obtained by polymerization of a curable acrylic monomer having at least three acrylic groups, i.e., acryloyl and/or methacryloyl groups. The protective layer not only shows a good durability against wearing but also can contain fine electroconductive particles therein with a good dispersibility because of the presence of the acrylic groups aiding the dispersion.

13 Claims, 1 Drawing Sheet

ELECTROPHOTOGRAPHIC PHOTOSENSITIVE MEMBER

This application is a continuation of application Ser. No. 07/709,822, filed Jun. 4, 1991, now abandoned.

FIELD OF THE INVENTION AND RELATED ART

The present invention relates to an electrophotographic photosensitive member having a protective layer, which can stably provide high-quality images even after repetitive use.

An electrophotographic photosensitive member is required to show desired sensitivity and electric properties depending on an electrophotographic process applied thereto as a matter of course. Particularly, an electrophotographic photosensitive member subjected to repetitive use is required to show durabilities against electrical and mechanical forces applied thereto during corona charging, toner development, transfer to paper and cleaning treatment. On the other hand, there is also a problem that a toner is attached to the surface layer, and therefore the photosensitive member is required to show an improved cleaning performance of the surface layer.

In order for the surface layer of a photosensitive member to show such required properties, it has been proposed to provide a resinous protective layer on a photosensitive layer. For example, Japanese Laid-Open Patent Application JP-A Sho 57-30843 has proposed a protective layer capable of having a controlled resistivity by using a mixture of a resin and electroconductive powder of a metal oxide.

However, in view of recent requirement of copied images of further improved image quality, a protective layer showing further improved properties in respects of electroconductivity, transparency, dispersion of an electroconductive substance, etc., in addition to a mechanical strength, is desired.

SUMMARY OF THE INVENTION

An object of the present invention is to provide an electrophotographic photosensitive member having a protective layer with electroconductive particles well dispersed therein and free from coating irregularity or pinholes.

Another object of the present invention is to provide an electrophotographic photosensitive member which is excellent in hardness and lubricity and has a durability against conspicuous wearing or occurrence of scars due to rubbing.

A further object of the present invention is to provide an electrophotographic photosensitive member which is excellent in potential characteristic and is capable of providing high-quality images free from spot-like image defects or fog.

According to the present invention, there is provided an electrophotographic photosensitive member, comprising: an electroconductive support, a photosensitive layer and a protective layer disposed in this order, said protective layer comprising a resin formed by polymerization of a curable acrylic monomer having at least three acrylic groups.

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 1:
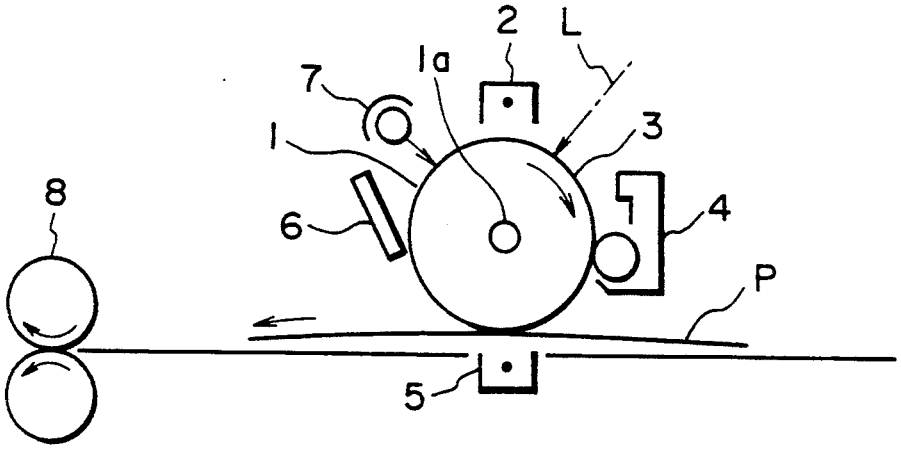
FIG. 1 is a schematic view illustrating the outline of an electrophotographic apparatus equipped with an electrophotographic photosensitive member according to the present invention.

The electrophotographic photosensitive member according to the present invention has a protective layer comprising a resin formed by polymerization of a polyfunctional curable acrylic monomer having at least three acrylic groups. Herein, the term "acrylic group" is used to inclusively mean both acryloyl and methacrylol groups.

Thus, examples of the curable acrylic monomer may include acrylate monomers and methacrylate monomers having at least three (meth)acryloyl groups.

In the present invention, the polyfunctional acrylic monomer may be used singly to form a resin or used in mixture of two or more species to form a copolymer resin. It is also possible to mix the polyfunctional acrylic monomer with another curable monomer, particularly, a photocurable monomer to form a copolymer resin. In any case, the polyfunctional acrylic monomer should preferably be used in a proportion of at least 20 wt. %, particularly at least 30 wt. %, of the total monomer.

Further, the polyfunctional acrylic monomer having at least three acrylic groups can be used in mixture with another resin. Examples of such another resin may include: polyester, polycarbonate, polyvinyl chloride, cellulose resin, fluorine-containing resin, polyethylene, polyurethane, acrylic resin other than those described above of the present invention, epoxy resin, silicone resin, alkyd resin and various copolymers, such as vinyl chloride-vinyl acetate copolymer resin, etc. In such a mixture, the polyfunctional acrylic monomer of the present invention may preferably be used in an amount constituting at least 20 wt. %, particularly at least 30 wt. %, of the total of the monomer and resin constituting the protective layer.

The polyfunctional acrylic monomers having at least three acrylic groups used in the present invention may for example include those represented by the following structural formulae (1)–(3).

Formula

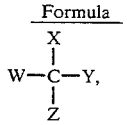

(1)

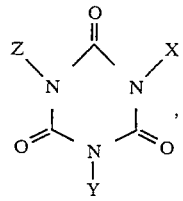

(2)

and

-continued

Formula

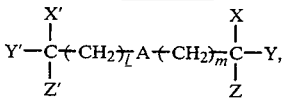

(3)

In the above formulae (1)–(3), X, Y, Z, W, X', Y' and Z' independently denote hydrogen atom, alkyl group, aralkyl group, aryl group or functional group including acrylic group as defined below, A denotes —O— or —S—, l and m independently denote an integer of 0–10 with the proviso that at least three of X, Y, Z and W in the formula (1) and (2) or of X, Y, Z, X', Y' and Z' in the formula (3) are functional groups including acrylic groups selected from alkyl groups having terminal $-OR$, $-OR_2$, $-\underset{\underset{O}{\|}}{C}(CH_2)_nOR_1$, $-\underset{\underset{O}{\|}}{C}(CH_2)_nOR_2$, -continued $(CH_2)_pO-\underset{\underset{O}{\|}}{C}(CH_2)_qOR_1$, $(CH_2)_pO-\underset{\underset{O}{\|}}{C}(CH_2)_qOR_2$, $(CH_2)_pO(CH_2)_qOR_1$ and $(CH_2)_pO(CH_2)_qOR_2$, wherein $R_1$ denotes $-\overset{\overset{O}{\|}}{C}-CH=CH_2$ (acryloyl), $R_2$ denotes $-\overset{\overset{O}{\|}}{C}-\overset{\overset{CH_3}{|}}{C}=CH_2$ (methacryloyl), and n, p and q independently denote an integer of 0–10.

Hereinbelow, some preferred examples of the polyfunctional acrylic monomer used in the present invention are described hereinbelow but they are not exhaustive.

| No. | Structural formula | Number of acrylic unsaturations |
|---|---|---|
| 1 | $CH_3CH_2-C(CH_2OR_1)_3$ | 3 |
| 2 | $CH_3CH_2-C(CH_2CH(CH_3)OR_2)_3$ | 3 |
| 3 | $CH_2CH(CH_2OR_1)-C(CH_3)(CH_2CH(CH_3)OR_2)_2$ | 3 |
| 4 | $CH_2CH(CH_2CHOR_1)-C(CH_3)(CH_2OR_1)_2$ | 3 |
| 5 | $HOCH_2-C(CH_2OR_2)_3$ | 3 |
| 6 | $HOCH_2-C(CH_2OR_1)_2-CH_2OCH_2-C(CH_2OR_1)_2-CH_2OH$ | 4 |
| 7 | $R_1OCH_2-C(CH_2OR_1)_2-CH_2OCH_2-C(CH_2OR_1)_2-CH_2OR_1$ | 6 |
| 8 | $(R_2OCH_2)_3C-CH_2OCH_2-C(CH_2OR_2)(R_2-OC_2H_{10}-C(=O))_2$ | 6 |
| 9 | 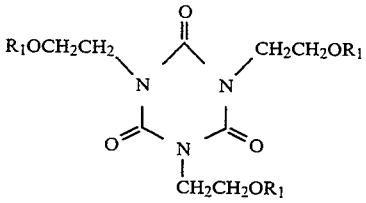 | 3 |
| 10 | $CH_3CH_2C(CH_2OC_3H_6OR_1)_3$ | 3 |

-continued
| No. | Structural formula | Number of acrylic unsaturations |
|---|---|---|
| 11 | 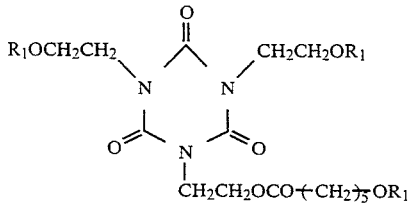 | 3 |
| 12 | $(R_1OCH_2)_3C-O-C(CH_2OR_1)_3$ | 6 |
| 13 | $(R_1OCH_2)_3CH_2OCH_2-C(H)(CH_2OR_1)_2$ | 5 |
| 14 | $(R_1OCH_2)_3CH_2OCH_2-C(CH_3)(CH_2OR_1)_2$ | 5 |
| 15 | $(R_1OCH_2)_3CH_2OCH_2-C(CH_2OH)(CH_2OR_1)_2$ | 5 |
| 16 | $(R_2OCH_2)_3CH_2OCH_2-C(CH_2OR_2)(CH_2OH)_2$ | 4 |
| 17 | $(R_1OCH_2)_3C-O-C(CH_2OH)(CH_2OR_1)_2$ | 5 |
| 18 | 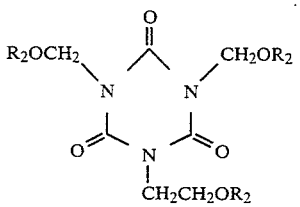 | 3 |
| 19 | $CH_3CH_2C(CH_2CH_2OR_1)_3$ | 3 |
| 20 | $HOCH_2-C(CH_2O-C(=O)CH_2CH_2CH_2CH_2CH_2OR_1)_3$ | 3 |
| 21 | 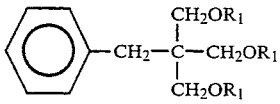 | 3 |
| 22 | 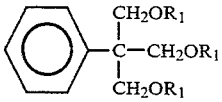 | 3 |
| 23 | 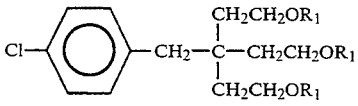 | 3 |
| 24 | 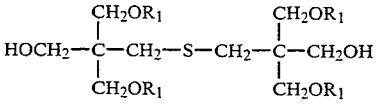 | 4 |
| 25 | 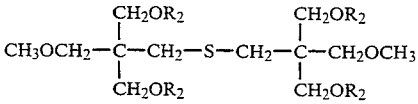 | 4 |

-continued

| No. | Structural formula | Number of acrylic unsaturations |
|---|---|---|
| 26 | 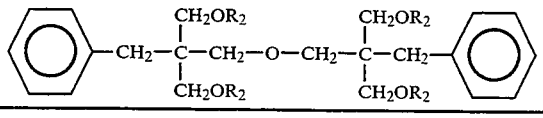 | 4 |

The protective layer in the electrophotographic photosensitive member according to the present invention may preferably have a thickness in the range of 0.1–10 microns, particularly 0.5–7 microns.

The protective layer may be formed by applying a paint comprising a polyfunctional curable acrylic monomer as described above and an appropriate solvent onto a photosensitive layer directly or by the medium of an intermediate layer, followed by drying and curing on exposure to light or heat. The solvent may be selected as desired as far as it dissolves the acrylic monomer used in the present invention.

The application of the paint may be suitably performed by spray coating, beam coating, or can be performed by dipping through selection of an appropriate solvent.

When the protective layer is cured by exposure to light, the acrylic paint composition is caused to contain a photoinitiator. The photoinitiator may be added in a proportion of 0.1 to 50 wt. %, preferably 0.5 to 30 wt. %, of the acrylic monomer.

The light used for curing may be actinic radiation including ultraviolet rays, X rays and electron beams. The photoinitiator may be any one which can generate radicals on exposure to such acetinic radiations, and examples thereof may include those represented by the following structural formulae:

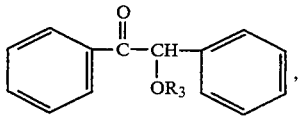

$R_3$ = isopropyl or isobutyl,

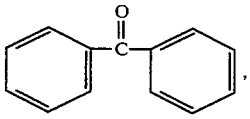

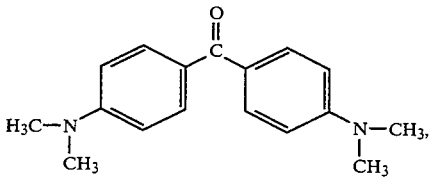

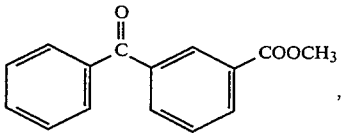

-continued

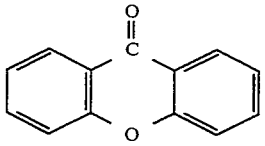

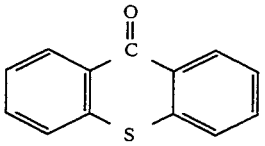

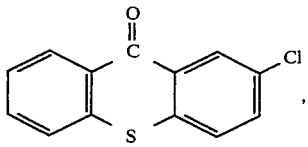

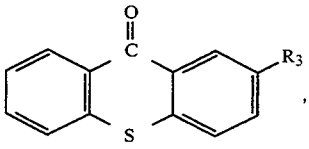

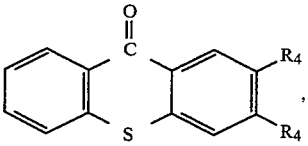

$R_4$ = isopropyl, methyl or ethyl,

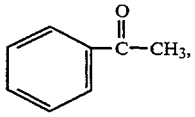

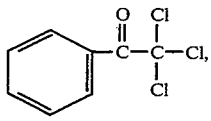

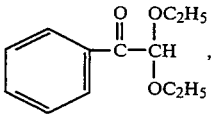

and

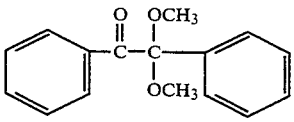

Since the acrylic monomer has at least three acrylic groups, the acrylic resin after the curing is caused to have a fully-developed three-dimensional crosslinked structure, so that the protective layer is provided with an excellent mechanical strength.

In the present invention, it is preferred to disperse electroconductive particles, such as metal particles, metal oxide particles or carbon black in the protective layer so as to control the electroconductivity thereof.

In case where particles are dispersed in a protective layer of an electrophotographic photosensitive member, it is generally necessary that the particles have a size sufficiently smaller than the wavelength of exposure light so as to prevent the scattering of the exposure light. In order to provide a uniform conductivity, it is necessary to uniformly disperse small electroconductive particles. For these reasons, the electroconductive particles may preferably have a number-average primary particle size of at least 1000 Å, particularly at most 500 Å, before the dispersion.

Accordingly, the resin used for constituting the protective layer is required to have a good ability of dispersing fine particles therein and also an ability of preventing the dispersed particles from agglomerating to form secondary particles to the utmost.

The acrylic monomer used in the present invention has at least three acrylic groups and has a relatively high polarity, so that the monomer shows a good ability of dispersing particles and can sufficiently uniformly disperse such ultra fine electroconductive particles as described above. As a result, the paint dispersion is stable for a long period, and the protective layer formed by applying, drying and curing the paint may be provided with an extremely high transparency and an extremely uniform electroconductivity.

In a specific example for evaluating a dispersing ability of a polyfunctional acrylic monomer, several lots of tin oxide particles having different primary particle sizes each in an amount of 30 wt. parts were respectively mixed with 60 wt. parts of an acrylic monomer represented by the following structural formula and 300 wt. parts of toluene, and the mixture was subjected to dispersion in a sand mill for 48 hours.

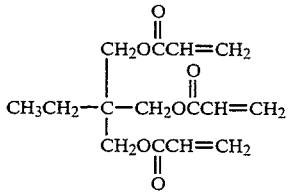

Table 1 appearing hereinbelow shows the particle sizes of the tin oxide particles with respect to the following items:

(1) Average primary particle size before the dispersion by measuring the particle sizes of 100 tin oxide particles before the dispersion having a particle size of 50 Å or larger taken at random by observation through an electron microscope (TEM) at a magnification of $2\times10^5$ and taking an average of the measured values;

(2) Average particle size of the tin oxide particles within the liquid dispersion immediately after the dispersion; and (3) Average particle size of the tin oxide particles in the liquid dispersion after one month of standing after the dispersion.

The average particle sizes in the items of (2) and (3) above were measured by a particle size-measuring apparatus ("Horiba CAPA-700" having a lower detection limit of 300 Å, available from Horiba Seisakusho K.K.)

TABLE 1

| Average particle size of tin oxide (Å) | | |
|---|---|---|
| Primary | Particles within liquid dispersion | |
| particles before dispersion | Immediately after dispersion | One month after dispersion |
| 400 | 500 | 500 |
| 800 | 1100 | 1200 |
| 1000 | 1300 | 1500 |
| 2000 | 2500 | 4000 |

As is clear from the above results, the acrylic monomer used in the present invention provides a dispersion showing a particle size after the dispersion which is close to the primary particle size before the dispersion and which does not remarkably change with lapse of time, thus showing a good ability of dispersing fine particles.

Examples of metal oxide particles suitably used in the present invention may include fine particles of metal oxide, such as zinc oxide, titanium oxide, tin oxide, antimony oxide, indium oxide, bismuth oxide, tin oxide-coated titanium oxide, tin-coated indium oxide, antimony-coated tin oxide and zirconium oxide. These metal oxides may be used singly or in mixture of two or more species. When two or more species of metal oxides are used, they can assume a form of solid solution or agglomerate.

The metal oxide particles may preferably be contained in a proportion of 5–90 wt. %, further preferably 10–80 wt. %, of the protective layer.

Further, in the present invention, the protective layer can optionally contain additives, such as a coupling agent and an antioxidant for improvements in dispersibility, adhesiveness, environmental stability, etc.

The protective layer may be formed directly or indirectly on a photosensitive layer of the electrophotographic photosensitive member according to the present invention.

The photosensitive layer may assume either a so-called single-layer structure containing both a charge generating substance and a charge transporting substance, or a so-called function-separated laminate structure including a charge transport layer containing a charge transporting substance and a charge generation layer containing a charge generating substance.

The laminate type photosensitive layer may assume a structure including a charge transport layer and a charge generation layer disposed in this order on an electroconductive support, or a structure including a charge transport layer and a charge generation layer disposed in this order on an electroconductive substrate. Particularly, in the latter structure of photosensitive member, the charge generation layer which is generally a very thin layer constitutes an upper layer, so that it is very effective to dispose a protective layer thereon according to the present invention.

The charge generation layer may preferably have a thickness of at most 5 microns, particularly 0.5–1 micron.

The charge generation layer may be formed by dispersing a charge generating substance selected from, e.g., azo pigments, such as Sudan Red and Dian Blue, quinone pigments, such as pyrenquinone and anthoanthrone, quinocyanine pigments, perylene pigments, indigo pigments, such as indigo and thioindigo, azulenium salt pigments, and phthalocyanine pigments, such as copper-phthalocyanine and oxytitanium-phthalocyanine, within a binder resin together with an appropriate solvent, applying the resultant dispersion, and drying the applied layer of the dispersion.

The binder resin may be selected from a wide scope of insulating resins or organic photoconductive polymers, and suitable examples thereof may include: polyvinyl butyral, polyvinyl benzal, polyarylate, polycarbonate, polyester, phenoxy resin, cellulosic resin, acrylic resin and polyurethane. The binder resin may preferably be used in an amount constituting at most 80 wt. %, particularly at most 40 wt. %, of the charge generation layer.

The solvent used may be any one as far as it dissolves the binder resin used, and specific examples thereof may include: ethers, such as tetrahydrofuran and 1,4-dioxane; ketones, such as cyclohexanone and methyl ethyl ketone; amides, such as N,N-dimethylformamide; esters such as methyl acetate and ethyl acetate; aromatics, such as toluene, xylene and chlorobenzene; alcohols, such as methanol, ethanol and 2-propanol; and aliphatic halogenated hydrocarbons, such as chloroform, methylene chloride dichloroethylene, carbon tetrachloride, and trichloroethylene.

The charge transport layer may be formed by dissolving a charge transporting substance selected from, e.g., polycyclic aromatic compounds including a structure of e.g., biphenylene, anthracene, pyrene or phenanthrene in their main chain or side chain; nitrogen-containing cyclic compounds, such as indole, carbazole, oxadiazole and pyrazoline; and hydrazone compounds, and styryl compounds; in an appropriate solvent together with a binder resin to form a coating liquid, and applying and drying the coating liquid. The binder resin is used because a charge transporting substance generally has a low-molecular weight and lacks a sufficient film-forming characteristic.

Examples of the binder resin may include: insulating resins, such as acrylic resin, polyarylate, polyester, polycarbonate, polystyrene, acrylonitrilestyrene copolymer, polyacrylamide, polyamide and chlorinated rubber; and organic photoconductive polymers, such as poly-N-vinylcarbazole and polyvinylanthracene.

The charge transport layer may preferably have a thickness of 5–40 microns, particularly 10–30 microns.

The single-layer type photosensitive layer may be formed by a combination of a charge generating substance and a charge transporting substance, and optionally a binder. In this case, it is also possible to use a charge transfer complex comprising, e.g., a combination of poly-N-vinylcarbazole and trinitrofluorene.

The single photosensitive layer may preferably have a thickness of 5–40 microns, particularly 10–30 microns.

In the present invention, it is possible to dispose an intermediate layer between the photosensitive layer and the protective layer for the purpose of providing improved adhesiveness, latitude of application, etc. The intermediate layer may be formed by a material, such as casein, polyvinyl alcohol, nitrocellulose, ethylene-acrylic acid copolymer, alcohol-soluble polyamide, polyurethane, gelatin or aluminum oxide.

The intermediate layer may preferably have a thickness of 0.1–10 microns, further preferably 0.3–2 microns.

In the present invention, it is also possible to dispose an undercoating layer between the electroconductive support and the photosensitive layer. The undercoating layer may be formed by a material similar to one selected from the class of materials for the intermediate layer.

The undercoating layer may preferably have a thickness of 0.1–5 microns, further preferably 0.5–3 microns.

The undercoating layer can also contain electroconductive particles, such as those of metal, metal oxide and carbon black. It is also possible to laminate such an undercoating layer containing electroconductive particles and an electroconductive particle-free undercoating layer in this order on a support. In this case, the electroconductive particles-containing undercoating layer may have a thickness of 0.1–50 microns, preferably 0.5–40 microns.

The above-mentioned various layers may be respectively formed by applying the respective coating liquids or paints containing an appropriate solvent by appropriate coating methods, such as dipping, spraying, beam coating, spinner coating, roller coating, wire bar coating, and blade coating, and drying the applied layer.

The electroconductive support used in the present invention may be formed from any materials having an electroconductivity inclusive of metals, such as aluminum, copper, chromium, nickel, zinc and stainless steel; plastic film coated with a metal foil of, e.g., aluminum and copper; plastic film coated with a vapor-deposited layer of, e.g., aluminum, indium oxide or tin oxide; and sheets of metal, plastic or paper coated with an electroconductive layer formed by application of an electroconductive substance together with an appropriate binder resin.

Examples of such an electroconductive substance constituting an electroconductive layer may include: particles of metals, such as aluminum, copper, nickel, and silver; foil and short fiber of metals; particles of electroconductive metal oxides, such as antimony oxide, indium oxide and tin oxide; electroconductive polymers, such as polypyrrole, polyaniline, and polymeric electrolytes; carbon fiber, carbon black and graphite powder; organic and inorganic electrolytes; and particles coated with an electroconductive substance as described above.

The electroconductive support may assume an arbitrary shape, such as a drum, a sheet or a belt selected corresponding to an electrophotographic apparatus using the photosensitive member.

The electrophotographic photosensitive member according to the present invention may be generally applicable to electrophotographic apparatus, such as copying machines, laser beam printers, LED printers, and LC-shutter printers, and also various apparatus, such as those for display, recording, small-scale printing, plate-production and facsimile communication.

FIG. 1 shows a schematic structural view of an ordinary transfer-type electrophotographic apparatus using an electrophotosensitive member of the invention. Referring to FIG. 1, a photosensitive drum (i.e., photosensitive member) 1 as an image-carrying member is rotated about an axis 1*a* at a prescribed peripheral speed in the direction of the arrow shown inside of the photosensitive drum 1. The surface of the photosensitive drum is uniformly charged by means of a charger 2 to have a prescribed positive or negative potential. The photosensitive drum 1 is exposed to light-image L (as by slit exposure or laser beam-scanning exposure) by using an image exposure means (not shown), whereby an electrostatic latent image corresponding to an exposure image is successively formed on the surface of the photosensitive drum 1. The electrostatic latent image is developed by a developing means 4 to form a toner image. The toner image is successively transferred to a transfer material P which is supplied from a supply part (not shown) to a position between the photosensitive drum 1 and a transfer charger 5 in synchronism with the rotating speed of the photosensitive drum 1, by means of the transfer charger 5. The transfer material P with the toner image thereon is separated from the photosensitive drum 1 to be conveyed to a fixing device 8, followed by image fixing to print out the transfer material P as a copy outside the electrophotographic apparatus. Residual toner particles on the surface of the photosensitive drum 1 after the transfer are removed by means of a cleaner 6 to provide a cleaned surface, and residual charge on the surface of the photosensitive drum 1 is erased by a pre-exposure means 7 to prepare for the next cycle. As the charger 2 for charging the photosensitive drum 1 uniformly, a corona charger is widely used in general. As the transfer charger 5, such a corona charger is also widely used in general.

According to the present invention, in the electrophotographic apparatus, it is possible to provide a device unit which includes plural means inclusive of or selected from the photosensitive member (photosensitive drum), the charger, the developing means, the cleaner, etc. so as to be attached or released as desired. The device unit may, for example, be composed of the photosensitive member and at least one device of the charger, the developing means and the cleaner to prepare a single unit capable of being attached to or released from the body of the electrophotographic apparatus by using a guiding means such as a rail in the body. The device unit can be accompanied with the charger and/or the developing means to prepare a single unit.

In a case where the electrophotographic apparatus is used as a copying machine or a printer, exposure light-image L may be given by reading a data on reflection light or transmitted light from an original or on the original, converting the data into a signal and then effecting a laser beam scanning, a drive of LED array or a drive of a liquid crystal shutter array.

Figure 2:
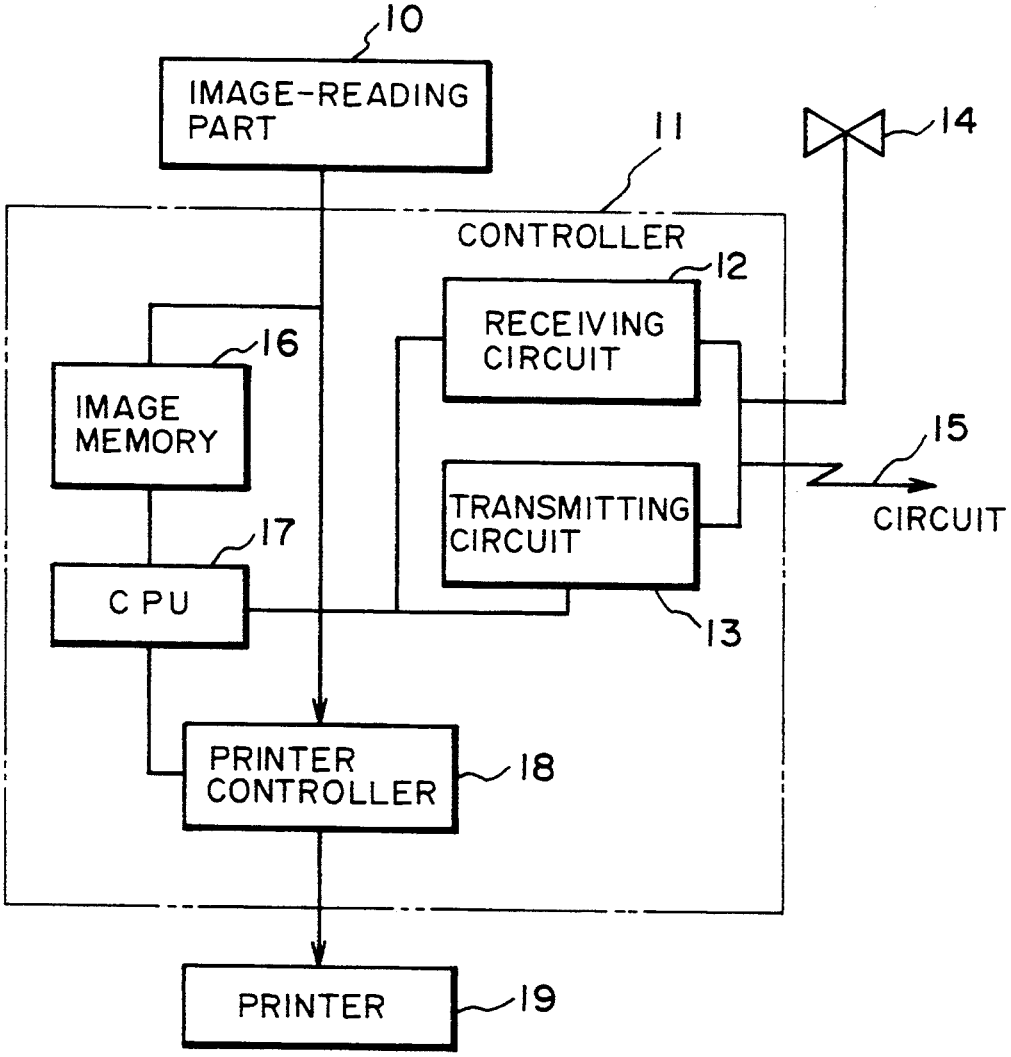
FIG. 2 is a block diagram of a facsimile apparatus including such an electrophotographic apparatus as a printer.

In a case where the electrophotographic apparatus according to the present invention is used as a printer of a facsimile machine, exposure light-image L is given by exposure for printing received data. FIG. 2 shows a block diagram of an embodiment for explaining this case. Referring to FIG. 2, a controller 11 controls an image-reading part 10 and a printer 19. The whole controller 11 is controlled by a CPU (central processing unit) 17. Read data from the image-reading part is transmitted to a partner station through a transmitting circuit 13, and on the other hand, the received data from the partner station is sent to the printer 19 through a receiving circuit 12. An image memory memorizes prescribed image data. A printer controller 18 controls the printer 19, and a reference numeral 14 denotes a telephone handset.

The image received through a circuit 15 (the image data sent through the circuit from a connected remote terminal) is demodulated by means of the receiving circuit 12 and successively stored in an image memory 16 after a restoring-signal processing of the image data. When image for at least one page is stored in the image memory 16, image recording of the page is effected. The CPU 17 reads out the image data for one page from the image memory 16 and sends the image data for one page subjected to the restoring-signal processing to the printer controller 18. The printer controller 18 receives the image data for one page from the CPU 17 and controls the printer 19 in order to effect image-data recording. Further, the CPU 17 is caused to receive image for a subsequent page during the recording by the printer 19. As described above, the receiving and recording of the image are performed.

Hereinbelow, the present invention will be explained based on Examples wherein "part(s)" means "part(s) by weight" unless otherwise indicated specifically.

EXAMPLE 1

50 parts of electroconductive titanium oxide powder coated with tin oxide containing 10%-antimony oxide, 25 parts of a phenolic resin ("Pli-O-Phen J-325", mfd. by Dai-Nippon Ink K.K.), 20 parts of methyl cellosolve, 5 parts of methanol and 0.002 part of silicone oil (polydimethylsiloxane-polyoxyalkylene copolymer, Mn (number-average molecular weight)=3000) were mixed and dispersed with each other in a sand mill apparatus using 1 mm-dia. glass beads for 2 hours to obtain an electroconductive paint.

An aluminum cylinder (30 mm-dia.×260 mm-long) was coated by dipping with the above-prepared paint, followed by 30 minutes of drying at 140° C., to form a 20 micron-thick electroconductive layer.

Separately, 10 parts of an alcohol-soluble copolymer nylon resin (Mw (weight-average molecular weight)=29000) and 30 parts of methoxymethylated 6-nylon resin (Mw=32000) were dissolved in a mixture solvent of 260 parts of methanol and 40 parts of butanol. The thus-formed mixture solution was applied by dipping onto the above-prepared electroconductive layer to form a 1 micron-thick undercoating layer.

Then, 10 parts of a styryl compound of the formula shown below and 10 parts of polycarbonate (Mw=46000) were dissolved in a mixture solvent of 20 parts of dichloromethane and 40 parts of monochlorobenzene. The resultant solution was applied by dipping onto the undercoating layer, followed by 60 min. of drying at 120° C., to form a 18 micron-thick charge transport layer.

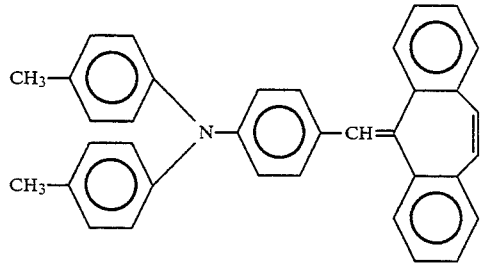

Separately, 4 parts of a disazo pigment of the formula below, 8 parts of polyvinyl butyral (butyral degree=68%, Mw=24000) and 34 parts of cyclohexanone were dispersed for 2 hours in a sand mill using 100 parts of 1 mm-dia. glass beads. The resultant dispersion was diluted with 60 parts of tetrahydrofuran (THF) to form a liquid dispersion for a charge generation layer.

The liquid dispersion was applied by spraying onto the charge transport layer, followed by 15 min. of drying at 80° C., to form a 0.15 micron-thick charge generation layer.

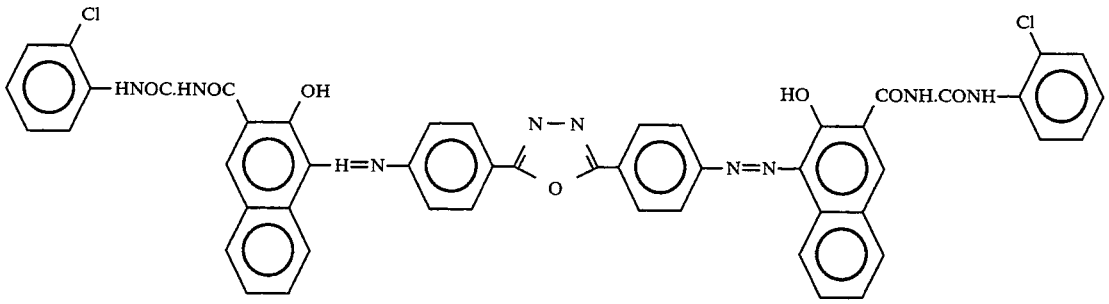

Separately, 60 parts of a polyfunctional acrylic monomer of the above-mentioned example No. 6, 30 parts of ultra-fine tin oxide particles having an average particle size of 400 Å before dispersion, 0.1 part of 2-methylthioxanthone as a photo-initiator and 300 parts of toluene were subjected to 48 hours of dispersion in a sand mill. The average particle size of the tin oxide particles immediately after the dispersion was 490 Å.

The resultant mixture liquid was applied in the form of a beam (i.e. by beam coating) onto the above-prepared charge generation layer to form a layer, which was then dried and subjected to photocuring for 20 seconds at a photo-intensity of 8 mW/cm$^2$ from a high-pressure mercury lamp to form a 4 micron-thick protective layer.

The dispersibility of the liquid dispersion for the protective layer was good, and the resultant protective layer had a uniform surface free of irregularity.

The thus-prepared electrophotographic photosensitive member was positively charged by corona discharge at +5 KV by using an electrostatic copying paper tester ("Model SP-428", mfd. by Kawaguchi Denki K.K.), then held for 1 second in a dark place and exposed for 10 seconds at an illuminance of 2 lux. from a halogen lamp, whereby the charging characteristics of the electrophotographic photosensitive member was evaluated.

The evaluated charging characteristics included a surface potential ($V_0$) after the charging, a sensitivity in terms of an exposure quantity ($E_{\frac{1}{2}}$) required for reducing the surface potential after 1 second of standing in the dark to a half, and a residual potential after the 10 seconds of the exposure.

Further, the electrophotographic photosensitive member was incorporated in an electrophotographic copying apparatus of the normal development-type equipped with a corona charger of +6.5 KV, an exposure system, a developing device, a transfer charger, a blade cleaning means and a discharging exposure system, and subjected to a durability test by 10000 sheets of repetitive image-formation.

The images before and after the durability test were evaluated, and the coating layer thickness of the photosensitive member was measured both before and after the durability test was measured by an eddy current-type film thickness meter (mfd. by KETT Co.) to obtain an abrasion thickness.

The results are shown in Table 2 appearing hereinafter together with the results of other examples. As is clear from the results shown in Table 2, the electrophotographic photosensitive member of this example showed good charging characteristics and provided good images free from image defects of spots or streaks.

EXAMPLES 2-4

Photosensitive members were prepared and evaluated in the same manner as in Example 1 except that the polyfunctional acrylic monomer was replaced by those of the above-mentioned monomer examples Nos. 1, 9 and 13, respectively. The results are also shown in Table 2.

EXAMPLE 5

An aluminum cylinder was coated with an electroconductive layer and an undercoating layer in the same manner as in Example 1.

Then, 10 parts of a charge transporting substance and 10 parts of polycarbonate (Mw=25000) were dissolved in a mixture solvent of 20 parts of dichloromethane and 40 parts of monochlorobenzene, and the resultant solution was applied by dipping onto the above-prepared undercoating layer, followed by 60 minutes of drying, to form a 15 micron-thick charge transport layer.

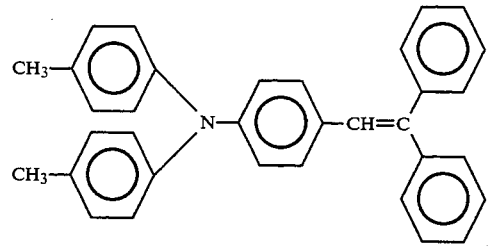

Separately, 4 parts of a disazo pigment of the formula shown below, 2 parts of polyvinyl benzal (benzal degree=80%, Mw=11000) and 30 parts of cyclohexanone were dispersed for 20 hours is a sand mill using 1 mm-dia. glass beads, and then diluted with 60 parts of methyl ethyl ketone to form a liquid dispersion for a charge generation layer. The liquid dispersion was applied by spraying onto the above-prepared charge transport layer and dried for 15 minutes at 80° C. to form a 0.10 micron-thick charge generation layer.

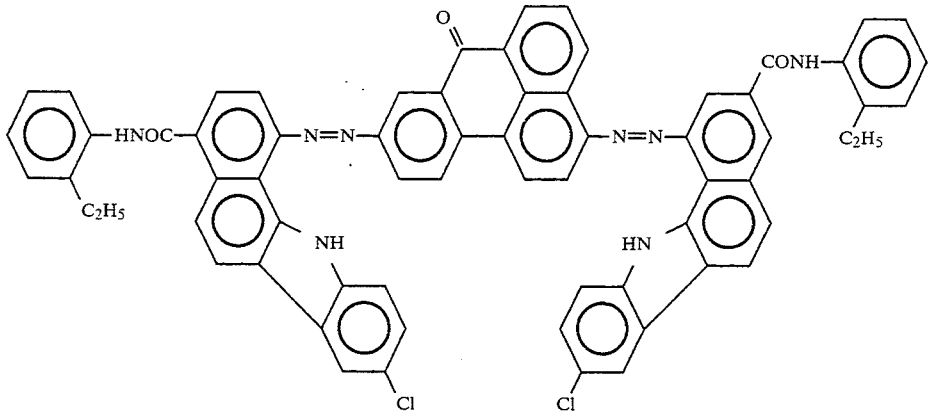

Separately, 60 parts of a polyfunctional acrylic monomer of the above-mentioned example No. 11, 30 parts of ultra-fine tin oxide particles having an average particle size of 400 Å before dispersion, 0.06 part of benzophenone as a photo-initiator and 300 parts of toluene were subjected to 24 hours of dispersion in a ball mill. The average particle size of the tin oxide particles immediately after the dispersion was 470 Å.

The resultant mixture liquid was applied in the form of a beam (i.e. by beam coating) onto the above-prepared charge generation layer to form a layer, which was then dried and subjected to photocuring for 30 seconds at a photo-intensity of 8 mW/cm$^2$ from a high-pressure mercury lamp to form a 4.5 micron-thick protective layer.

The dispersibility of the liquid dispersion for the protective layer was good, and the resultant protective layer had a uniform surface free of irregularity.

The thus-prepared electrophotographic photosensitive member was evaluated in the same manner as in Example 1. The results are also shown in Table 2.

EXAMPLE 6

A photosensitive member was prepared and evaluated in the same manner as in Example 5 except that the liquid dispersion for the protective layer was replaced with one prepared by dispersing a mixture liquid of 30 parts of a polyfunctional acrylic monomer of the above-mentioned example No. 7, 50 parts of ultra-fine tin oxide particles having an average particle size of 400 Å before dispersion, 0.1 part of 2-methylthioxanthone and 300 parts of toluene for 24 hours in a sand mill.

The results are shown in Table 2.

EXAMPLES 7–12

Electrophotographic photosensitive members were prepared in the same manner as in Examples 1–6, respectively, except that the order of disposing the charge transport layer and the charge generation layer in each example was reversed from those in Examples 1–6, respectively.

The thus-prepared photosensitive members were evaluated in the same manner as in Example 1 except that the photosensitive members were charged negatively. The results are inclusively shown in Table 3 appearing hereinafter.

EXAMPLES 13–18

Electrophotographic photosensitive members were prepared in the same manner as in Examples 1–6, respectively, except that a 1 micron-thick intermediate layer was disposed between the charge generation layer and the protective layer by using a coating liquid identical to the one for the undercoating layer in each Example.

The thus prepared photosensitive members were respectively evaluated in the same manner as in Example 1. The results are shown in Table 4 appearing hereinafter.

Comparative Examples 1 and 2

Photosensitive members were prepared and evaluated in the same manner as in Examples 1 and 7, respectively, except that the protective layer was not provided in each Example. The results are shown in Table 5 appearing hereinafter.

As shown in Table 5, the photosensitive members showed good electrophotographic characteristic at the initial stage but provided inferior results in the durability test. Particularly, in Comparative Example 1, the surface charge generation layer was abraded around 300 sheets, so that it was difficult to obtain good images.

Comparative Examples 3 and 4

Photosensitive members were prepared and evaluated in the same manner as in Examples 7 and 13, respectively, except that the polyfunctional acrylic monomer was replaced by an acrylic monomer of the following formula:

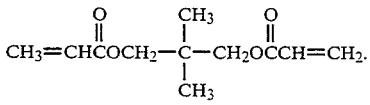

The results are also shown in Table 5.

In preparation of the liquid dispersion for the protective layer, the tin oxide particles in the liquid immediately after the dispersion showed an average particle size of 1500 A increased from 400 A as the primary particle size before the dispersion.

Comparative Examples 5 and 6

Electrophotographic photosensitive members were prepared and evaluated in the same manner as in Examples 11 and 17, respectively, except that bisphenol A-type polycarbonate resin (Mn=50000) was used instead of the polyfunctional acrylic monomer. The results are also shown in Table 5.

TABLE 2

| | Electrophotographic characteristics | | | Image quality | | Abrasion after the durability test (μm) |
|---|---|---|---|---|---|---|
| | Dark part potential (V) | Sensitivity $E_{\frac{1}{2}}$ (lux · sec) | Residual potential (V) | Initial stage | After 10000 sheets | |
| Example 1 | 840 | 2.3 | 20 | Good | Good | 1.5 |
| Example 2 | 820 | 2.2 | 30 | " | " | 1.5 |
| Example 3 | 830 | 2.4 | 35 | " | " | 1.2 |
| Example 4 | 820 | 2.5 | 20 | " | " | 1.0 |
| Example 5 | 840 | 2.0 | 25 | " | " | 1.1 |
| Example 6 | 840 | 1.9 | 20 | " | " | 1.5 |

TABLE 3

| | Electrophotographic characteristics | | | Image quality | | Abrasion after the durability test (μm) |
|---|---|---|---|---|---|---|
| | Dark part potential (V) | Sensitivity $E_{\frac{1}{2}}$ (lux · sec) | Residual potential (V) | Initial stage | After 10000 sheets | |
| Example 7 | −840 | 2.0 | −10 | Good | Good | 1.3 |
| Example 8 | −830 | 1.9 | −15 | " | " | 1.3 |
| Example 9 | −830 | 1.8 | −10 | " | " | 1.2 |
| Example 10 | −825 | 1.9 | −20 | " | " | 1.0 |
| Example 11 | −840 | 1.8 | −15 | " | " | 1.0 |
| Example 12 | −830 | 1.7 | −10 | " | " | 1.3 |

TABLE 4

| | Electrophotographic characteristics | | | Image quality | | Abrasion after the durability test (μm) |
|---|---|---|---|---|---|---|
| | Dark part potential (V) | Sensitivity $E_{\frac{1}{2}}$ (lux · sec) | Residual potential (V) | Initial stage | After 10000 sheets | |
| Example 13 | 850 | 2.2 | 25 | Good | Good | 1.5 |

TABLE 4-continued

| | Electrophotographic characteristics | | | Image quality | | Abrasion after the durability test (μm) |
|---|---|---|---|---|---|---|
| | Dark part potential (V) | Sensitivity $E_{\frac{1}{2}}$ (lux · sec) | Residual potential (V) | Initial stage | After 10000 sheets | |
| Example 14 | 840 | 2.1 | 35 | " | " | 1.5 |
| Example 15 | 850 | 2.2 | 35 | " | " | 1.2 |
| Example 16 | 835 | 2.3 | 30 | " | " | 1.0 |
| Example 17 | 860 | 1.8 | 30 | " | " | 1.1 |
| Example 18 | 850 | 1.9 | 15 | " | " | 1.5 |

TABLE 5

| | Electrophotographic characteristics | | | Image quality | | Abrasion after the durability test (μm) |
|---|---|---|---|---|---|---|
| | Dark part potential (V) | Sensitivity $E_{\frac{1}{2}}$ (lux · sec) | Residual potential (V) | Initial stage | After or during 10000 sheets of durability test | |
| Comp. Ex. 1 | 820 | 2.1 | 10 | Good | Image defects occurred at 300 sheets | — |
| Comp. Ex. 2 | −830 | 1.8 | −10 | " | Image density decreased | 7.0 |
| Comp. Ex. 3 | −840 | 2.2 | −40 | Black spots & image irregularity occurred | Black spots & irregularity increased | 3.6 |
| Comp. Ex. 4 | 830 | 3.3 | 30 | Black spots & image irregularity occurred | Black spots & irregularity increased | 3.0 |
| Comp. Ex. 5 | −850 | 3.5 | −95 | Black spots & image irregularity occurred | Black spots & irregularity increased | 4.0 |
| Comp. Ex. 6 | 820 | 3.8 | 80 | Black spots occurred | Image defects occurred at 7000 sheets | 3.1 |

What is claimed is:

1. An electrophotographic photosensitive member, comprising: an electroconductive support, a photosensitive layer and a protective layer disposed in this order, said protective layer formed by polymerization of a coating liquid comprising (a) a curable acrylic monomer having at least three acrylic groups and (b) electroconductive particles dispersed therein.

2. A photosensitive member according to claim 1, wherein said curable acrylic monomer is a photo-curable one.

3. A photosensitive member according to claim 1, wherein said curable acrylic monomer is selected from those represented by the following formula (1)–(3).

Formula

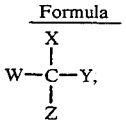

(1)

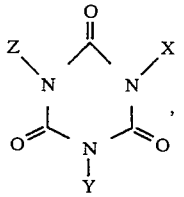

(2)

-continued

Formula and

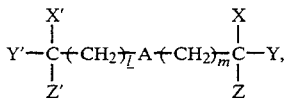

(3)

wherein X, Y, Z, W, X', Y' and Z' independently denote hydrogen atom, alkyl group, aralkyl group, aryl group or functional group including acrylic group as defined below, A denotes —O— or —S—, l and m independently denote an integer of 0–10 with the proviso that at least three of X, Y, Z and W in the formula (1) and (2) or of X, Y, Z, X', Y' and Z' in the formula (3) are functional groups including acrylic groups selected from alkyl groups having terminal —OR, —$OR_2$,

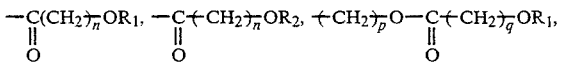

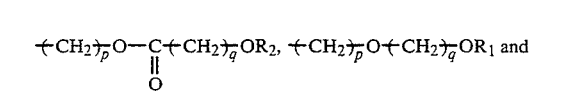

$-(CH_2)_p O-(CH_2)_q OR_2$, wherein $R_1$ denotes

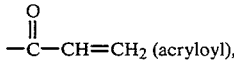

(acryloyl), $R_2$ denotes 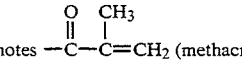 (methacryloyl), integer of 0–10.

4. A photosensitive member according to claim 1, wherein said electroconductive particles have an average primary particle size of at most 1000 Å.

5. A photosensitive member according to claim 4, wherein said electroconductive particles have an average primary particle size of at most 500 Å.

6. A photosensitive member according to claim 1, wherein said electroconductive particles are selected from the group consisting of metal particles, metal oxide particles and carbon black.

7. A photosensitive member according to claim 6, wherein said electroconductive particles comprise a metal oxide.

8. A photosensitive member according to claim 1, wherein said photosensitive layer comprises a charge generation layer and a charge transport layer.

9. A photosensitive member according to claim 8, wherein said charge transport layer is disposed on the charge generation layer.

10. A photosensitive member according to claim 8, wherein said charge generation layer is disposed on the charge transport layer.

11. A photosensitive member according to claim 1, wherein said photosensitive layer consists of a single layer.

12. A photosensitive member according to claim 1, wherein an undercoating layer is disposed between said electroconductive support and said photosensitive layer.

13. An electrophotographic apparatus, comprising: an electrophotographic photosensitive member, means for forming an electrostatic latent image, means for developing the formed electrostatic latent image and means for transferring the developed image to a transfer-receiving material;

said electrophotographic photosensitive member comprising an electroconductive support, a photosensitive layer and a protectic layer disposed in this order, said protective layer formed by polymerization of a coating liquid comprising (a) a curable acrylic monomer having at least three acrylic groups and (b) electroconductive particles dispersed therein.

* * * * *

UNITED STATES PATENT AND TRADEMARK OFFICE

CERTIFICATE OF CORRECTION

PATENT NO. : 5,391,449

DATED : February 21, 1995

INVENTOR(S) : AKIO MARUYAMA, ET AL.

It is certified that error appears in the above-identified patent and that said Letters Patent is hereby corrected as shown below:

COLUMN 3

Line 14, "formula (1)" should read --formulas (1)--.
Line 18, "—OR," should read -- —$OR_1$,--.

COLUMN 4

Line 19, "hereinbelow" should be deleted.

COLUMN 7

Line 38, "acetinic" should read --actinic--.

COLUMN 11

Line 47, "acrylonitrilestyrene" should read --acrylonitrile-styrene--.

COLUMN 14

Line 10, "image" should read --image data--.
Line 47, "a" should read --an--.

COLUMN 18

Line 59, "1500 A" should read --1500 Å-- and "400 A" should read --400 Å--.

COLUMN 20

Line 44, "polymerization" should read --providing a layer--.
Line 47, "therein." should read --therein over said photosensitive layer and thereafter polymerizing said curable acrylic monomer.--.
Line 53, "formula (1)-(3)" should read --formulas (1)-(3)--.

UNITED STATES PATENT AND TRADEMARK OFFICE

CERTIFICATE OF CORRECTION

PATENT NO. : 5,391,449

DATED : February 21, 1995

INVENTOR(S) : AKIO MARUYAMA, ET AL.

It is certified that error appears in the above-identified patent and that said Letters Patent is hereby corrected as shown below:

COLUMN 21

Line 15, "formula (1)" should read --formulas (1)--.
Line 19, "—OR," should read -- —$OR_1$,--.
Line 36, insert: --and n, p and q independently denote an--.

COLUMN 22

Line 35, "protectic" should read --protective--.
Line 36, "polymeriza-" should read --providing a layer--.
Line 37, "tion" should be deleted.
Line 40, "therein." should read --therein over said photosensitive layer and thereafter polymerizing said curable acrylic monomer.--.

Signed and Sealed this

Twenty-seventh Day of June, 1995

*Attest:*

Bruce Lehman

BRUCE LEHMAN

*Attesting Officer*

*Commissioner of Patents and Trademarks*